US010327995B2

(12) United States Patent
Wang et al.

(10) Patent No.: US 10,327,995 B2
(45) Date of Patent: Jun. 25, 2019

(54) AUTOMATIC MEDICINE RETRIEVING DEVICE

(71) Applicants: HONG FU JIN PRECISION INDUSTRY (ShenZhen) CO., LTD., Shenzhen (CN); HON HAI PRECISION INDUSTRY CO., LTD., New Taipei (TW)

(72) Inventors: Yu-Ting Wang, New Taipei (TW); King-Lung Huang, New Taipei (TW); Chao-Wen Shih, New Taipei (TW); Pang-Yen Jao, New Taipei (TW)

(73) Assignees: HONG FU JIN PRECISION INDUSTRY (ShenZhen) CO., LTD., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 319 days.

(21) Appl. No.: 15/368,760

(22) Filed: Dec. 5, 2016

(65) Prior Publication Data

US 2018/0104153 A1 Apr. 19, 2018

(30) Foreign Application Priority Data

Oct. 19, 2016 (TW) ..... 105133658 A

(51) Int. Cl.

| | |
|---|---|
| ***A61J 7/00*** | (2006.01) |
| ***B65D 83/04*** | (2006.01) |
| ***G07F 11/54*** | (2006.01) |
| ***G07F 17/00*** | (2006.01) |

(52) U.S. Cl.

CPC ..... *A61J 7/0076* (2013.01); *A61J 7/0069* (2013.01); *A61J 7/0084* (2013.01); *B65D 83/0454* (2013.01); *G07F 11/54* (2013.01); *G07F 17/0092* (2013.01)

(58) Field of Classification Search

None

See application file for complete search history.

(56) References Cited

U.S. PATENT DOCUMENTS

| | | | | |
|---|---|---|---|---|
| 3,712,507 A * | 1/1973 | Holt | G07F 11/54 | 221/150 R |
| 5,472,113 A * | 12/1995 | Shaw | A61J 7/0084 | 221/15 |
| 2006/0058724 A1* | 3/2006 | Handfield | A61J 7/0084 | 604/20 |
| 2014/0277702 A1* | 9/2014 | Shaw | G06F 19/3462 | 700/232 |

* cited by examiner

*Primary Examiner* — Gene O Crawford
*Assistant Examiner* — Ayodeji T Ojofeitimi
(74) *Attorney, Agent, or Firm* — ScienBiziP, P.C.

(57) ABSTRACT

An automatic medicine retrieving device includes a medicine tray, a medicine box, and a driving mechanism. The medicine tray includes a bearing plate defining an exit port and a medicine separating member rotatably positioned on the bearing plate. The medicine separating member has medicine separating areas and a positioning area. Medications in the form of pills are positioned on the bearing plate and received in the medicine separating areas. The medicine box is opposite to the exit port. The driving mechanism drives the medicine separating member to rotate from being opposite to the exit port, bringing the medicine separating area to a position opposite to the exit port. A pill in the medicine separating area then passes through the exit port to fall into an accepting mechanism.

14 Claims, 9 Drawing Sheets

AUTOMATIC MEDICINE RETRIEVING DEVICE

CROSS-REFERENCE TO RELATED APPLICATIONS

This application claims priority to Taiwan Patent Application No. 105133658, filed on Oct. 19, 2016, the contents of which are incorporated by reference herein.

FIELD

The subject matter herein generally relates to medication dispensers, and particularly to automated medication dispensers.

BACKGROUND

Generally, medication dispensing devices include an arm to grab medication. Many types of medication (e.g. pills) are stored together in a box. Medications stored in this way are prone to damage, because the medication tends to easily biodegrade or stick to other medication in the same storage compartment. Thus, the medication dispensing arm may grab more than one pill, or may not grab any pills at all.

BRIEF DESCRIPTION OF THE DRAWINGS

Implementations of the present disclosure will now be described, by way of example only, with reference to the attached figures.

DETAILED DESCRIPTION

Figure 1:
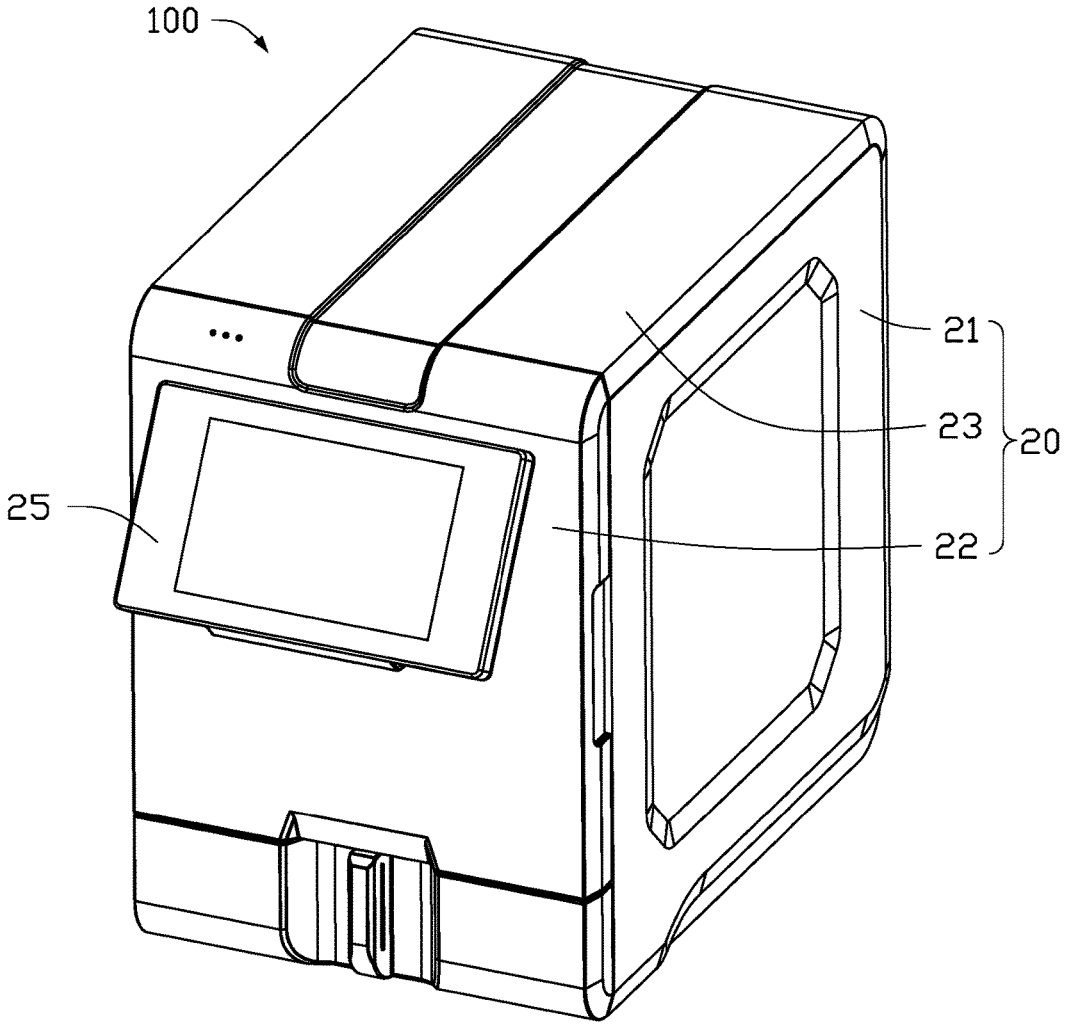
FIG. 1 is an isometric view of an exemplary embodiment of an automatic medication dispenser.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein.

The term "comprising" means "including, but not necessarily limited to"; it specifically indicates open-ended inclusion or membership in a so-described combination, group, series, and the like.

Figure 2:
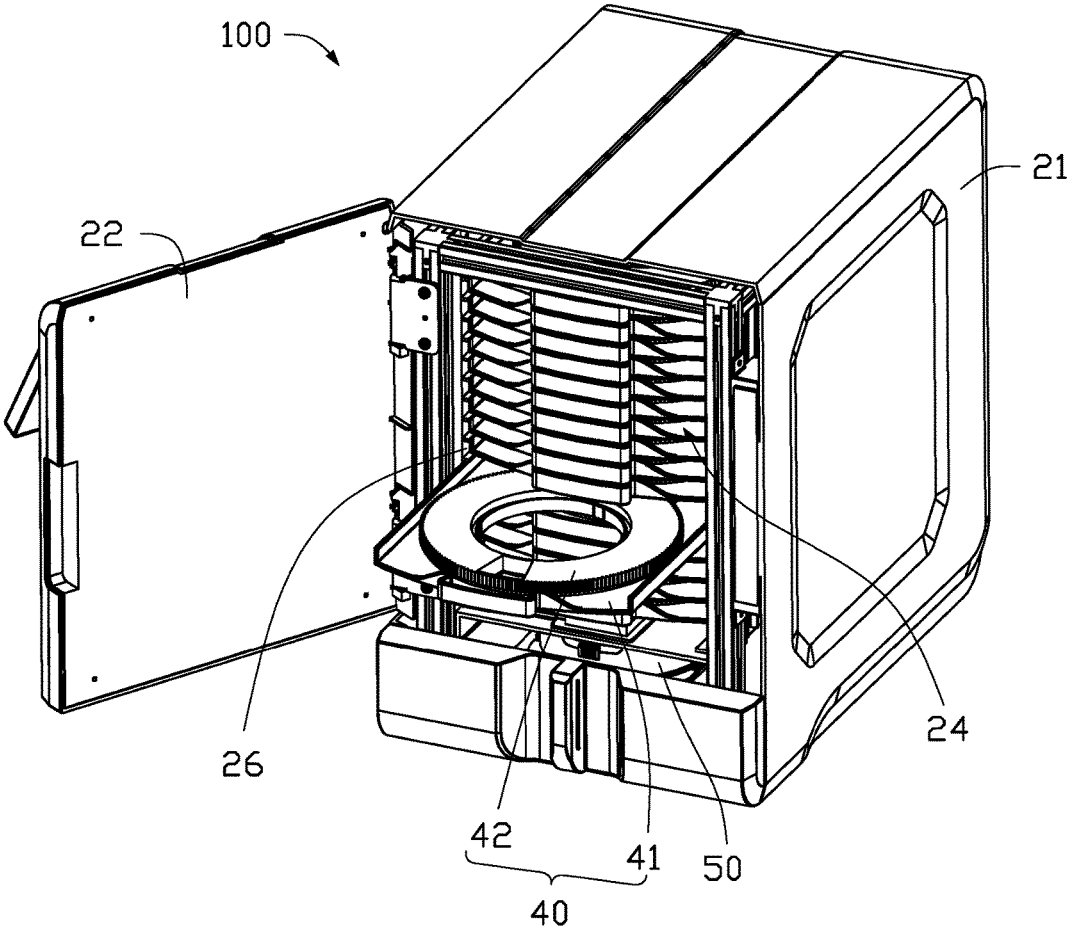
FIG. 2 is an isometric view of the dispenser of FIG. 1 with the door open.

FIGS. 1 and 2 illustrate an exemplary embodiment of an automatic medicine retrieving device 100 comprising a shell 20, a number of medicine trays 40, an accepting mechanism 50, and a driving mechanism 60. The medicine tray 40, the accepting mechanism 50, and the driving mechanism 60 are received in the shell 20. The medicine tray 40 stores pills. The driving mechanism 60 moves the medicine tray 40 making a pill fall into the accepting mechanism 50.

The shell 20 includes two lateral sidewalls 21, a door 22, and a top sidewall 23 positioned between the two lateral sidewalls 21. An opening 24 is defined between the two lateral sidewalls 21. The door 22 opens or closes the opening 24. The door 22 is rotatably attached to one of the lateral sidewalls 21. An interactive operating panel 25 is fixed on the door 22. A user may select the pill to be dispensed using the interactive operating panel 25. The two lateral sidewalls 21 include a number of pairs of opposite sliding rails 26. Restockable medicine trays 40 can be slidably received in or removed from each of the number of pairs of opposite sliding rails 26 in the shell 20 for a manager to put the pills.

Figure 3:
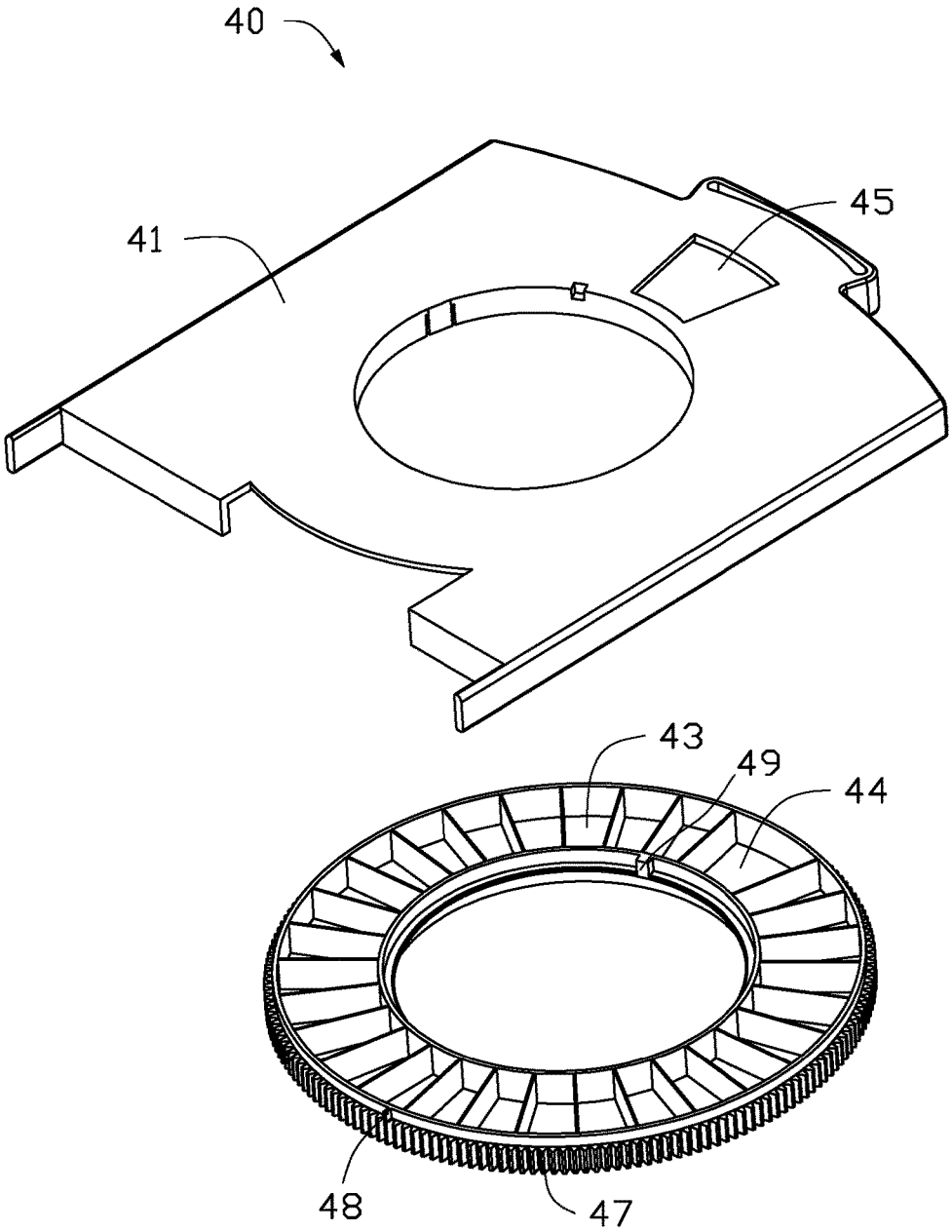
FIG. 3 is an exploded view of a medicine tray of the dispenser of FIG. 1.
Figure 4:
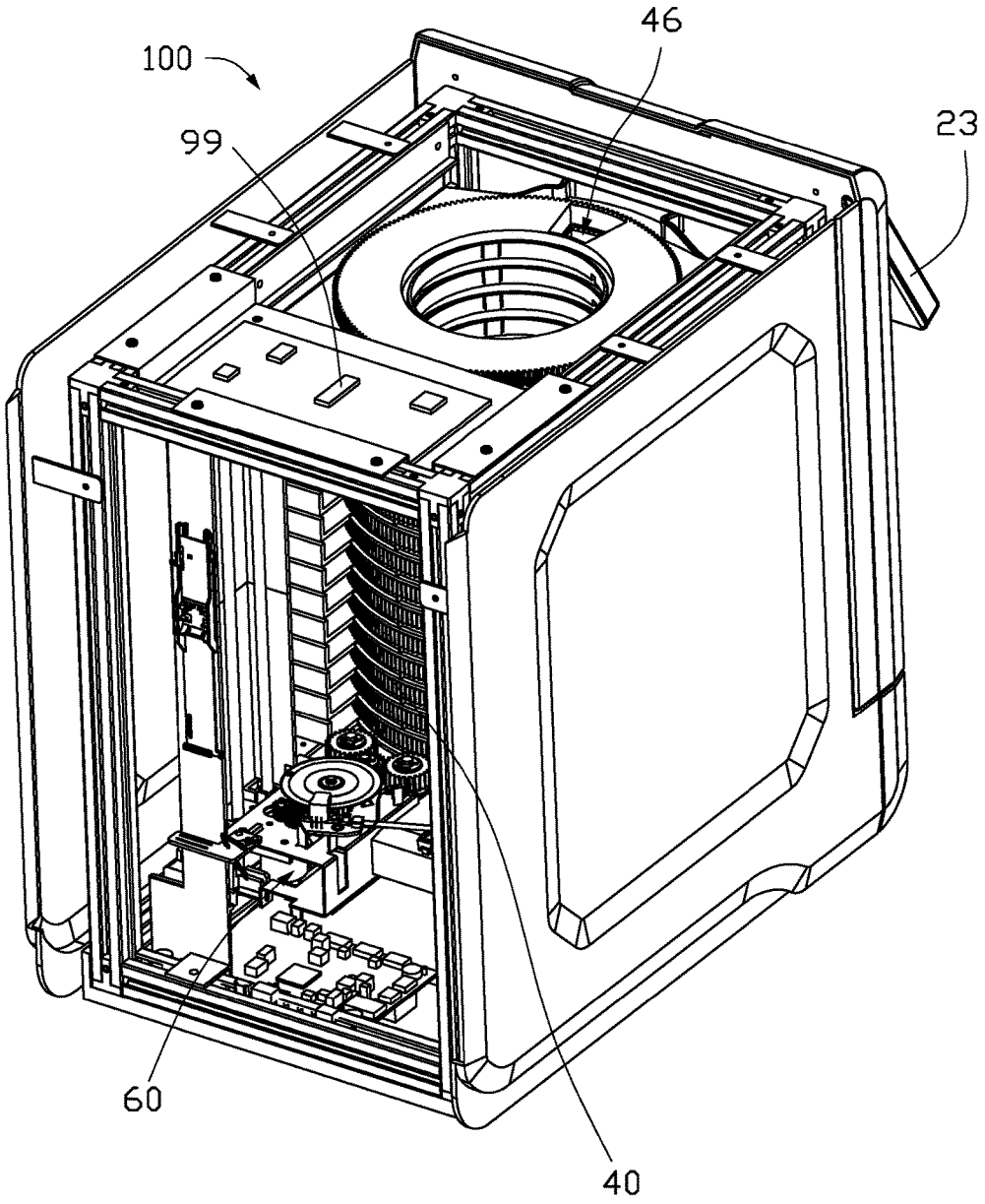
FIG. 4 is an isometric view of the dispenser of FIG. 1 with a part of the shell opened.

FIG. 3 illustrates an exemplary embodiment showing each medicine tray 40 includes a bearing plate 41 and an annular medicine separating member 42 positioned on the bearing plate 41. The medicine separating member 42 defines a number of medicine separating areas 43 and a positioning area 44. Each medicine separating area 43 receives a pill. The medicine separating member 42 is rotatable on the bearing plate 41. The bearing plate 41 defines a medicine port 45. The positioning area 44 is a through hole. Referring to FIGS. 2 and 4, as an exemplary embodiment, in an initial position, all of the positioning areas 44 are opposite to the medicine port 45 and form a channel 46. The accepting mechanism 50 is positioned under the last medicine tray 40 and in line with the channel 46. When a medicine separating area 43 of a medicine tray 40 rotates to be opposite to the medicine port 45, the pill in the medicine separating area 43 passes through the channel 46 to fall into the accepting mechanism 50.

Figure 5:
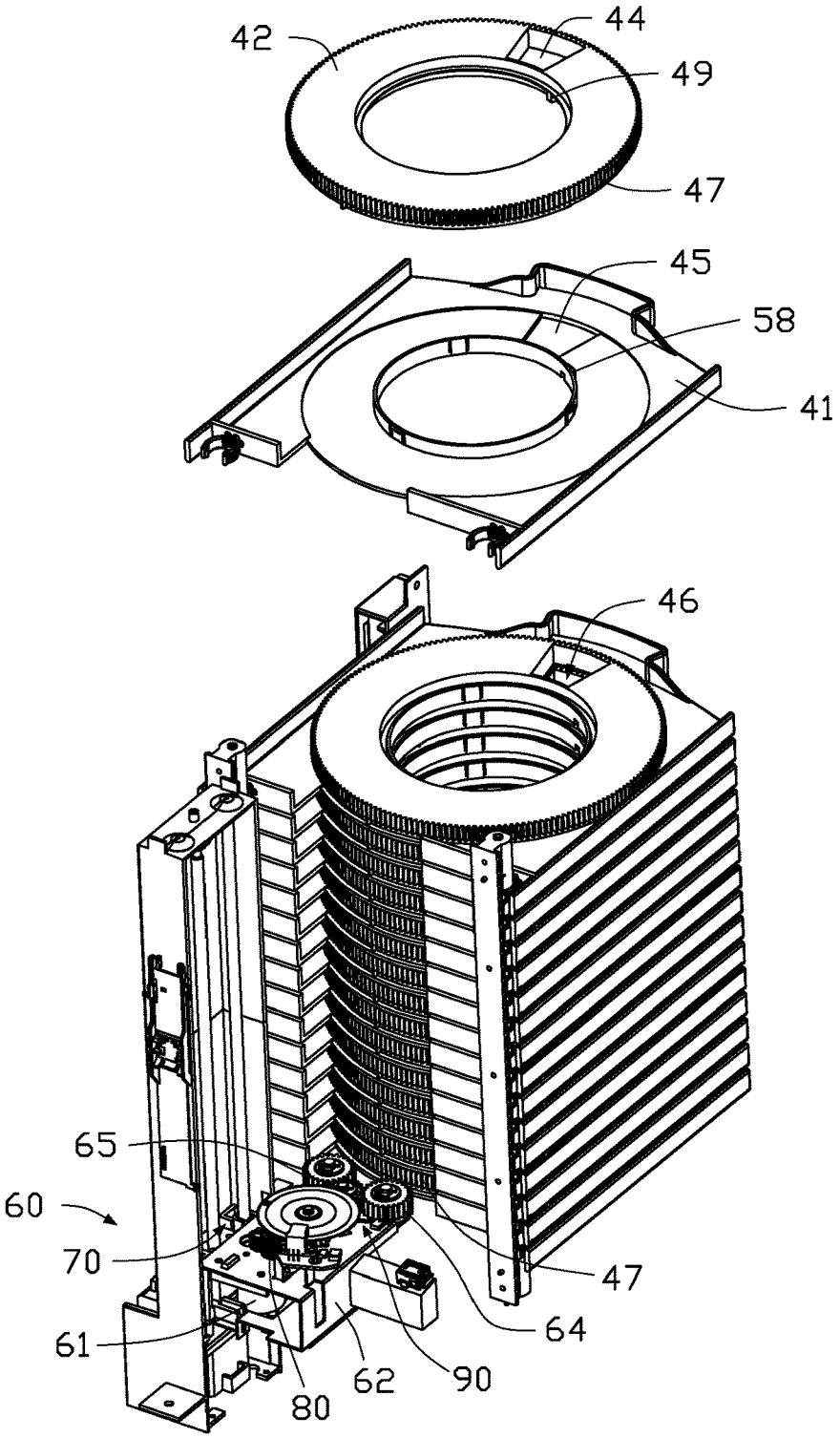
FIG. 5 is an isometric view of the dispenser of FIG. 1 with the shell omitted.
Figure 6:
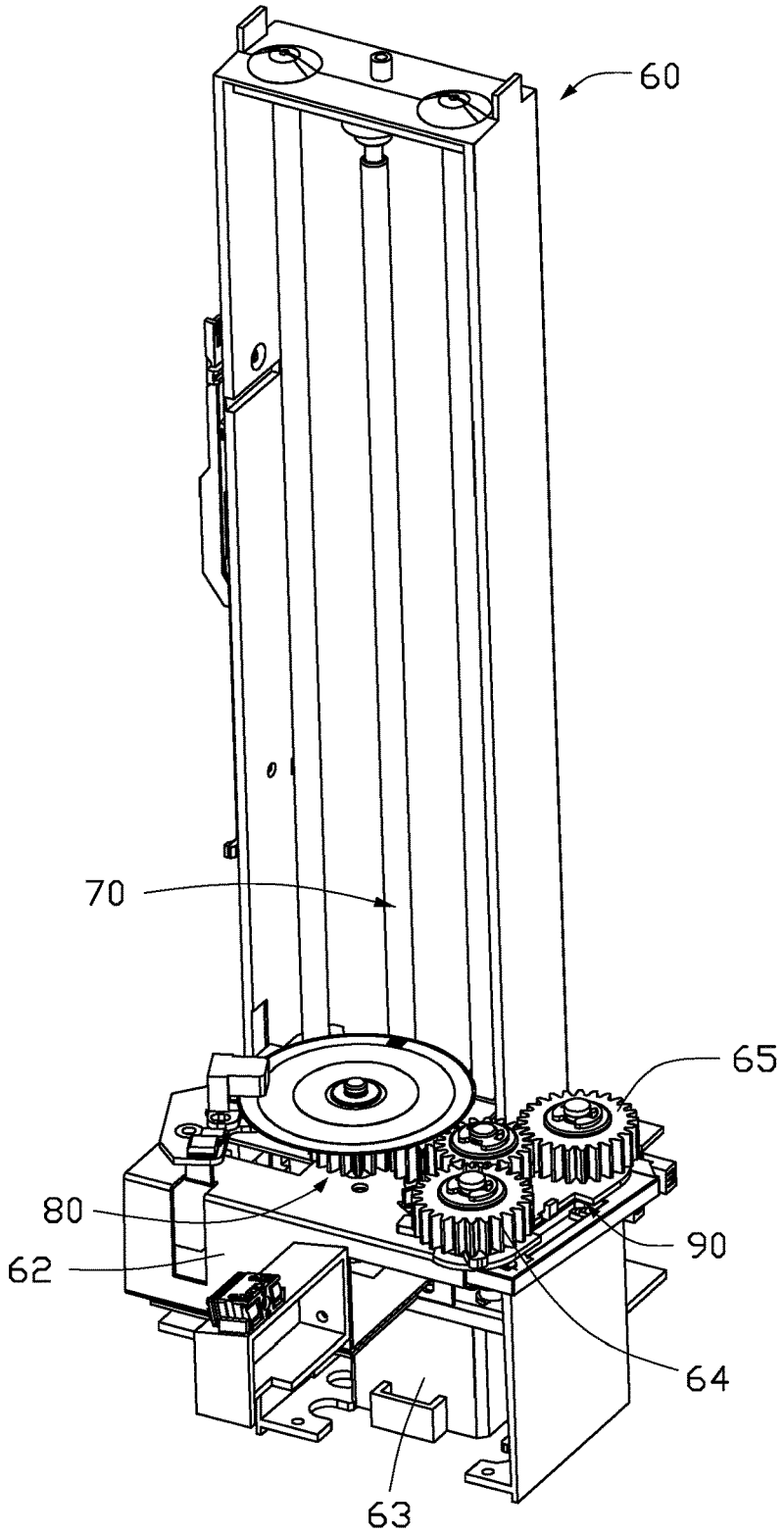
FIG. 6 is an isometric view of an exemplary embodiment of a driving mechanism of the dispenser of FIG. 1.

Referring to FIGS. 4 to 6, showing an exemplary embodiment of the driving mechanism 60 includes a first motor 63, a second motor 61, a first transferring device 80, a second transferring device 70, a bearing device 62, a swinging device 90, a first driving gear 64, and a second driving gear 65. The second transferring device 70 is attached to the second motor 61 and the bearing device 62. The second motor 61 drives the second transferring device 70 to move horizontally and the second transferring device 70 drives the bearing device 62 to move up and down. The first motor 63 is attached to the bearing device 62. The first transferring device 80 is positioned on the bearing device 62. The first transferring device 80 is attached to the first motor 63 and the swinging device 90. The first driving gear 64 and the second driving gear 65 are positioned on the swinging device 90. The medicine separating member 42 includes a number of teeth 47 on an external side of the medicine separating member 42.

When the first motor 63 rotates in a forward direction, the first transferring device 80 drives the swinging device 90 to swing in a first swinging direction making the first driving gear 64 engage in the teeth 47 of the medicine separating member 42. The first driving gear 64 rotates the medicine separating member 42 in a first direction. The medicine separating member 42 thereby moves from a first position where the positioning area 44 is opposite to the medicine port 45 to a second position where the medicine separating area 43 is opposite to the medicine port 45. The pill in the medicine separating area 43 can thus pass through the medicine port 45 and the channel 46 to fall into the accepting mechanism 50. When the first motor 63 rotates in a reverse direction, the first transferring device 80 drives the swinging device 90 to swing in a second swinging direction opposite to the first swinging direction thereby making the second driving gear 65 engage in the teeth 47 of the medicine separating member 42. The second driving gear 65 rotates the medicine separating member 42 in a second direction and the medicine separating member 42 moves back to the first position where the positioning area 44 is opposite to the medicine port 45.

Figure 7:
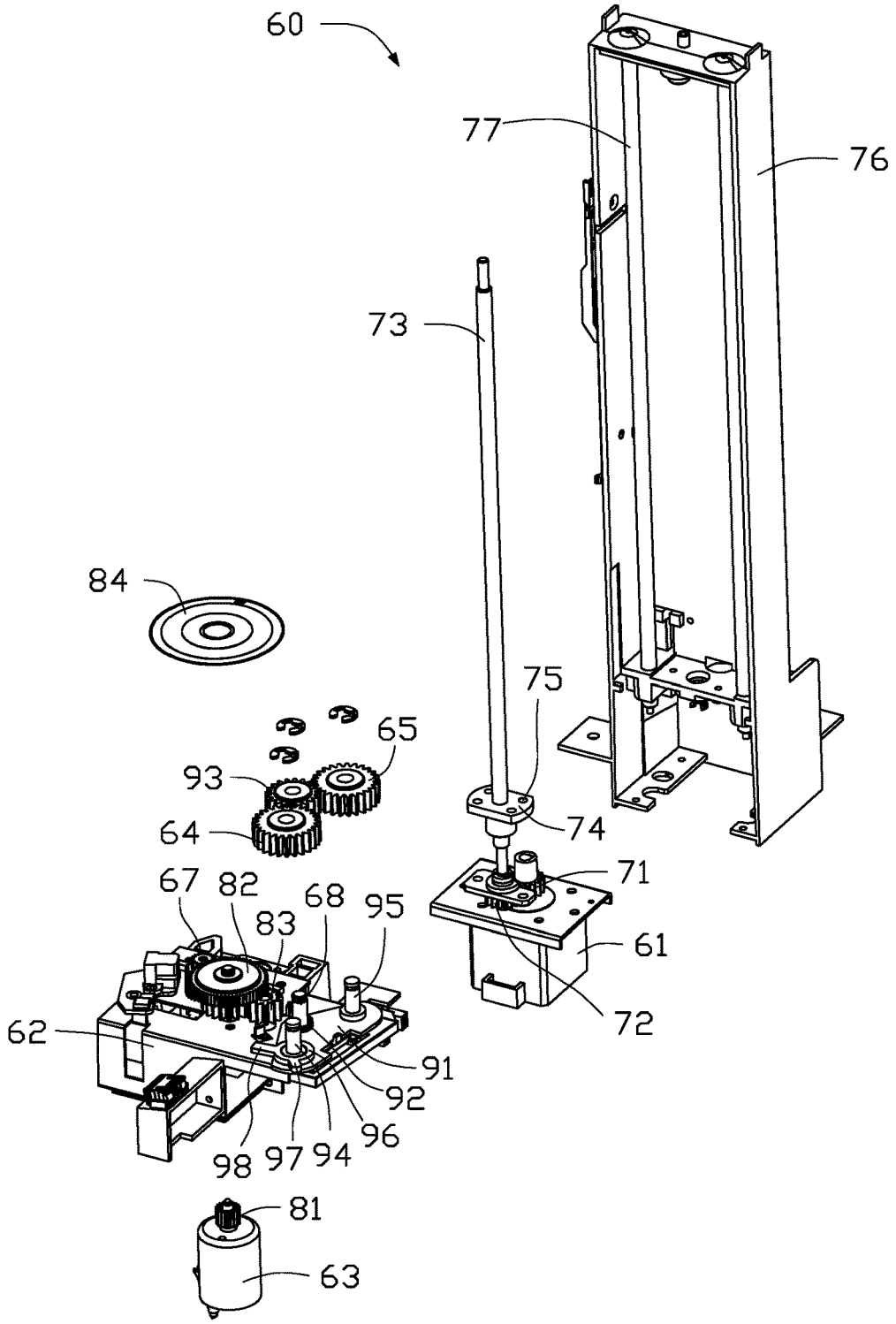
FIG. 7 is an exploded view of the driving mechanism of FIG. 6.
Figure 8:
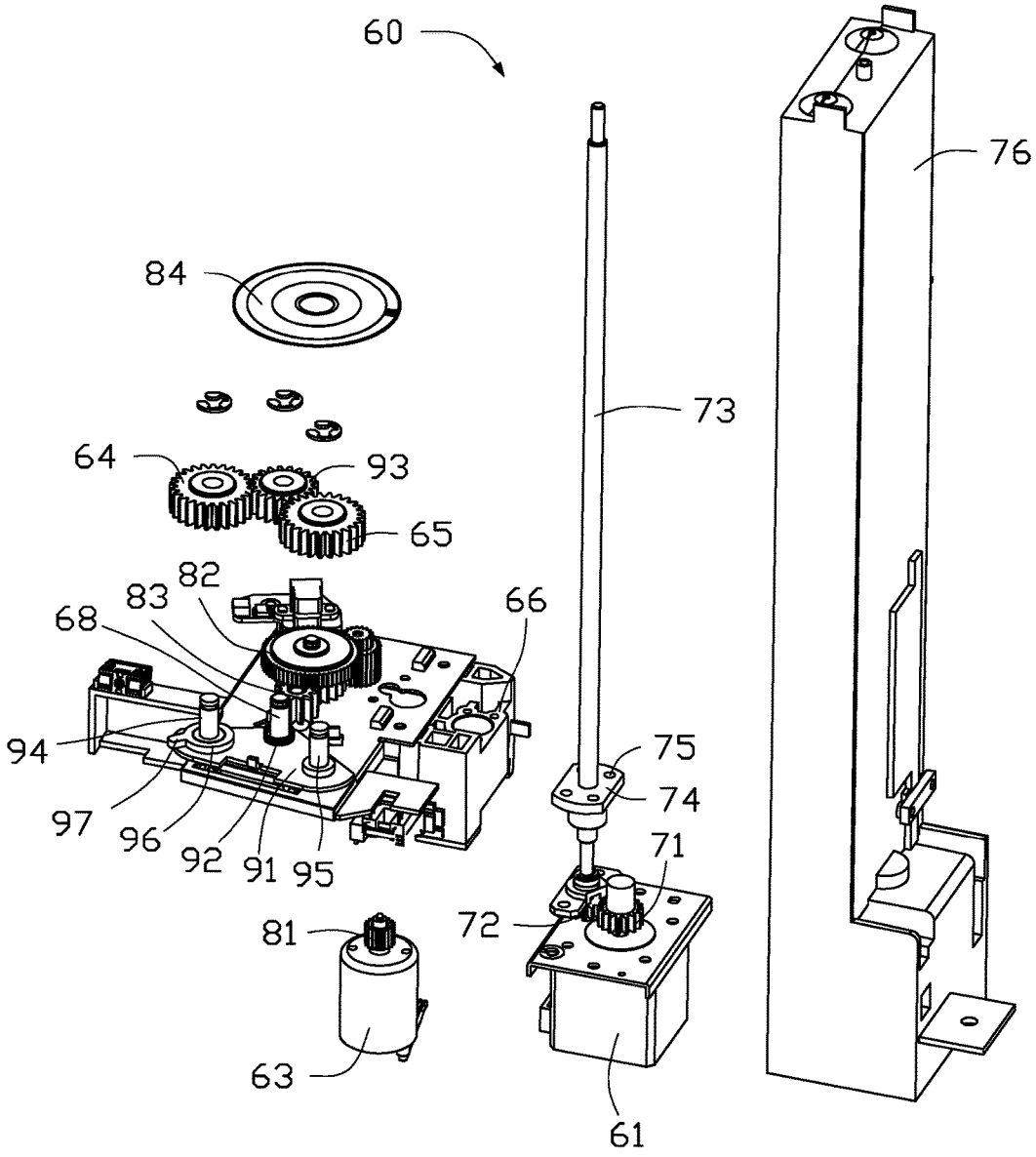
FIG. 8 is similar to FIG. 7, shown from another viewpoint.

FIGS. 4, 7, and 8 illustrate an exemplary embodiment of the automatic medicine retrieving device 100 which further includes a controller 99. The controller 99 electrically connects to the first motor 63 and the second motor 61. The controller 99 rotates the second motor 61 through different angles, and the second motor 61 drives the second transferring device 70 to move the bearing device 62 to different heights. Therefore, the first driving gear 64 can be opposite to different heights of the medicine trays 40. When the first driving gear 64 is at a certain position, the controller 99 rotates the first motor 63. The first transferring device 80 then swings the swinging device 90 making the first driving gear 64 engage in the teeth 47 of the medicine separating member 42. The first driving gear 64 rotates the medicine separating member 42. When the medicine separating area 43 rotates to a position which is opposite to the medicine port 45, the pill in the medicine separating area 43 passes through the medicine port 45 and the channel 46 to fall into the accepting mechanism 50.

The second transferring device 70 includes a first gear 71 sleeved on an output shaft of the second motor 61, a second gear 72 engaging with the first gear 71, a threaded rod 73 attached to the second gear 72, and a connecting member 74. The connecting member 74 is sleeved on the threaded rod 73 and is attached to the bearing device 62. The threaded rod 73 defines an external thread. The connecting member 74 defines a threaded hole. The connecting member 74 is screwed in the threaded hole of the connecting member 74. The first gear 71 rotates with the output shaft of the second motor 61. The second gear 72 and the threaded rod 73 rotate with the first gear 71. When the threaded rod 73 rotates, the connecting member 74 moves up and down along the threaded rod 73 making the bearing device 62 move up and down. In this exemplary embodiment, the connecting member 74 defines a number of threaded through holes 75. The bearing device 62 defines a number of threaded fixing holes 66. Bolts (not shown) are screwed into the threaded through holes 75 and the threaded fixing holes 66 to connect the connecting member 74 to the bearing device 62.

The second transferring device 70 further includes a frame 76 and two guiding poles 77. The two guiding poles 77 are fixed to the frame 76 and symmetrically positioned at each of the two sides of the threaded rod 73. The bearing device 62 defines two guiding holes 67. The bearing device 62 is sleeved on the two guiding poles 77 through the two guiding holes 67. The bearing device 62 can move along the two guiding poles 77.

The first transferring device 80 includes a third gear 81 sleeved on an output shaft (not labeled) of the first motor 63, a number of transferring gears 82, an output gear 83, and a rotation angle sensor 84. The transferring gears 82 are engaged between the third gear 81 and the output gear 83.

A first positioning shaft 68 is attached to the bearing device 62. The swinging device 90 includes a swinging plate 91, a damping member 92, and a swinging gear 93. The swinging plate 91 is sleeved on the first positioning shaft 68. A second positioning shaft 94 and a third positioning shaft 95 are attached to the swinging plate 91. The swinging gear 93 is sleeved on the first positioning shaft 68, the first driving gear 64 is sleeved on the second positioning shaft 94, and the second driving gear 65 is sleeved on the third positioning shaft 95. The first driving gear 64 and the second driving gear 65 align symmetrically and engage at the two sides of the swinging gear 93. The swinging gear 93 further engages with the output gear 83. The damping member 92 is sleeved on the first positioning shaft 68 between the swinging plate 91 and the swinging gear 93. In the exemplary embodiment, the damping member 92 is a spring acting as a damper.

Friction between the damping member 92 and the swinging gear 93 prevents the swinging gear 93 from rotating around its center axis toward a first direction while the swinging plate 91 rotates around the first positioning shaft 68 toward the first direction. Thus, the first driving gear 64 and the second driving gear 65 engage with the teeth 47 of the medicine separating member 42 before the output gear 83 rotates. When the output gear 83 rotates but before the first driving gear 64 and the second driving gear 65 engaging with the teeth 47 of the medicine separating member 42, the swinging gear 93 cannot rotate around its center axis toward a first direction, and the swinging plate 91 rotates around the first positioning shaft 68 toward the first direction. The swing of the first driving gear 64 and the second gear 72 follows the swinging plate 91. Since the swinging gear 93 is sleeved on the first positioning shaft 68, the swinging gear 93 revolves around the first positioning shaft 68 toward the first direction. The first driving gear 64 swings toward the medicine separating member 42, and the second driving gear 65 swings away from the medicine separating member 42. When the first driving gear 64 engages with the teeth 47 of the medicine separating member 42, the medicine separating member 42 prevents any further swinging by the swinging plate 91. Thus, the swinging plate 93 rotates around its center axis to drive the first driving gear 64 to rotate around the second positioning shaft 94, and the second gear 65 to rotate around the third positioning shaft 95. Then the first driving gear 64 can rotate the medicine separating member 42 in the first direction. When the medicine separating member 42 rotates to locate different medicine separating areas 43 at a position opposite to the medicine port 45, the pill in the medicine separating area 43 falls from the medicine tray 40.

The swinging device 90 further includes a pushing member 96 and a movement sensor (not shown). The pushing member 96 is rotatably sleeved on the second positioning shaft 94 and is positioned between the first gear 71 and the swinging plate 91. The pushing member 96 includes a pushing piece 97 and a shielding piece 98. Referring to FIG. 3, a blocking piece 48 protrudes externally from a side of the medicine separating member 42. When the first driving gear 64 engages with the teeth 47 of the medicine separating member 42, the pushing piece 97 touches the blocking piece 48. When the medicine separating member 42 rotates with the first driving gear 64, the medicine separating member 42 pushes the pushing piece to rotate the pushing member 96 around the second positioning shaft 94, and the shielding piece 98 thus moves. The movement sensor is positioned on the bearing device 62 and under the pushing member 96. The movement sensor senses movement by the shielding piece 98 and can determine whether the pushing piece 97 is pushed by the medicine separating member 42. In another exemplary embodiment, a sensor to read a pressing force is fixed to a distal end of the pushing member 96. When the pushing piece 97 touches the blocking piece 48, such sensor senses a pressing force to determine that the pushing piece 97 touches the blocking piece 48. Thus, the pushing piece 97 being pushed by medicine separating member 42 can be determined.

When the pushing piece 97 is pushed by medicine separating member 42, the angle sensor 84 senses an angle of rotation of the medicine separating member 42. In the exemplary embodiment, the rotation angle sensor 84 is a rotary encoder fixed on one of the transferring gear 82. The rotary encoder senses the angle of rotation of the fixed transferring gear 82 and transmits the rotation information to the controller 99. The controller 99 determines the angle of rotation of the medicine separating member 42 according to the rotation information of the fixed transferring gear 82 and a transferring relationship between the fixed transferring gear 82 and the medicine separating member 42. When the angle of rotation of the medicine separating member 42 reaches a preset angle, the controller 99 stops the rotation of the first motor 63. At the preset angle, the medicine separating area 43 which receives a pill is opposite to the medicine port.

Figure 9:
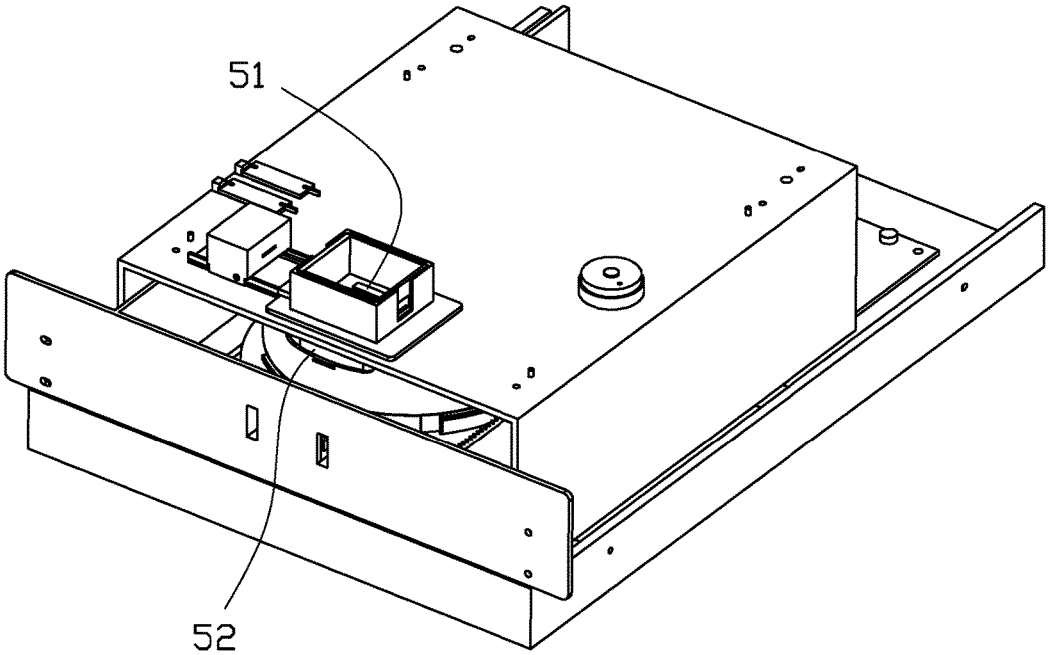
FIG. 9 is an isometric view of an exemplary embodiment of an accepting mechanism of the dispenser of FIG. 1.

Referring to FIGS. 2 and 9, the accepting mechanism 50 includes a pill sensor 51 and a medicine box 52. The pill sensor 51 senses the dropping and delivery of a pill. The medicine box 52 is positioned under the medicine port 45 and faces the medicine port 45. The medicine box 52 accepts the pill. The pill sensor 51 senses a fall of the pill. In an exemplary embodiment, the pill sensor 51 includes a light source and a light sensor opposite to the light source. The pill passes between the light source and the light sensor to fall into the medicine box 52. When the pill passes between the light source and the light sensor, the pill blocks the light from the light source, and the light sensor is triggered. The pill sensor 51 determines that a pill falls down. The accepting mechanism 50 is slidably received in the shell. When the pill is gathered, the accepting mechanism 50 can slide out of the shell 22.

When the pill falls down, the controller 99 rotates the first motor 63 in the back-forward direction. In another exemplary embodiment, when a time from the first motor 63 stopping rotation reaches a first preset period, the controller 99 rotates the first motor 63 in reverse. The first preset time allows the pill time to fall out of the medicine separating area 43, for example, this can be two seconds. Friction between the damping member 92 and the swinging gear 93 means that the swinging gear 93 cannot rotate around its center axis toward a second direction, the reverse of the first direction. Therefore, the swinging plate 91 rotates around the first positioning shaft 68 toward the second direction. The first driving gear 64 and the second gear 72 swing to follow the swinging plate 91. Since the swinging gear 93 is sleeved on the first positioning shaft 68, the swinging gear 93 revolves around the first positioning shaft 68 toward the second direction. The first driving gear 64 swings away from the medicine separating member 42 and the second driving gear 65 swings toward the medicine separating member 42. When the second driving gear 65 engages with the teeth 47 of the medicine separating member 42, the medicine separating member 42 prevents the swinging plate 91 from further swinging. The swinging plate 93 thus rotates around its center axis to drive the first driving gear 64 and the second gear 65 to respectively rotate around the second positioning shaft 94 and the third positioning shaft 95. Then the second driving gear 65 rotates the medicine separating member 42 in the second direction which is the reverse of the first direction of rotation.

Referring to FIGS. 3 and 5, a positioning piece 49 protrudes internally from a side of the medicine separating member 42. A stopping piece 58 protrudes from the bearing plate 41. When the positioning area 44 is opposite to the medicine port 45, the positioning piece 49 touches the stopping piece 58. The stopping piece 58 prevents the medicine separating member 42 from further rotation in the second direction. When the angle sensor 84 senses that the medicine separating member 42 has stopped rotating, the angle sensor 84 sends a stop rotating signal to the controller 99. In one exemplary embodiment, when the rotary encoder senses that the fixing transferring gear 82 has stopped rotating, the rotary encoder sends the stop rotating signal to the controller 99. In another exemplary embodiment, after the first motor 63 rotates in the reverse direction for a second preset period, the first motor 63 sends the stop rotating signal to the controller 99. According to the stop rotating signal, the controller 99 determines that the medicine separating member 42 is in a position where the positioning area 44 is opposite to the medicine port 45. The first motor 63 then rotates in the forward direction to drive the second driving gear 65 away from the teeth 47 of the medicine separating member 42, to move to the initial position. In this time, a pill delivery operation is complete, and the controller 99 controls the automatic medicine retrieving device 100 to take next selected pill. In the initial position, neither of the first driving gear 64 and the second driving gear 65 engage in the teeth 47 of the medicine separating member 42, and they can move up and down with the bearing device 62.

The exemplary embodiments shown and described above are only examples. Even though numerous descriptions and advantages of the present disclosure have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims.

What is claimed is:

1. An automatic medicine retrieving device comprising:

at least one medicine tray, each of the at least one medicine tray comprising:

a bearing plate, the bearing plate defining a medicine port; and a medicine separating member, the medicine separating member rotatably positioned on the bearing plate and defining a plurality of medicine separating areas and a positioning area, wherein a plurality of pills is positioned on the bearing plate and received in the medicine separating areas;

a bearing device;

an accepting mechanism comprising a medicine box opposite to the medicine port; and a driving mechanism, the driving mechanism configured to rotate the medicine separating member from a first position, where the positioning area is opposite to the medicine port, to a second position, where the medicine separating area is opposite to the medicine port, to allow the pill in the medicine separating area to pass through the medicine port to fall into the accepting mechanism;

wherein the driving mechanism drives the medicine separating member to rotate from the second position, where the medicine separating area is opposite to the medicine port, to the first position, where the positioning area is opposite to the medicine port; wherein the driving mechanism comprises a first motor, a first transferring device, a swinging device and a first driving gear; wherein the first driving gear is positioned on the swinging device, the first transferring device is attached to the first motor and the swinging device, and the medicine separating member comprises a plurality of teeth on an external side of the medicine separating member; wherein when the first motor rotates in a forward direction, the first transferring device swings the swinging device in a first swinging direction to drive the first driving gear to engage in the teeth of the medicine separating member; wherein the first driving gear drives the medicine separating member to rotate in a first direction to reach the second position; wherein the first driving gear, the second driving gear, and the swinging device are all positioned on the bearing device, and all of the positioning areas are opposite to the medicine port, all of the positioning areas and the medicine port forming a channel, the driving mechanism further comprises a second motor and a second transferring device, the second transferring device is attached to the second motor and the bearing device, the second motor drives the second transferring device to move, and the second transferring device drives the bearing device to move up and down.

2. The automatic medicine retrieving device of claim 1, wherein the driving mechanism further comprises a second driving gear, the second driving gear is positioned on the swinging device, when the first motor rotates in a backward direction, the first transferring device drives the swinging device to swing in a second swinging direction to drive the second driving gear to engage in the teeth of the medicine separating member, wherein, the second swing direction is reverse to the first swinging direction, and wherein the second driving gear drives the medicine separating member to rotate in a second direction, and the medicine separating member moves back to the first position.

3. The automatic medicine retrieving device of claim 2, wherein a first positioning shaft is attached to the bearing device, the swinging device comprises a swinging plate, a damping member, and a swinging gear;

wherein the swinging gear is sleeved on the first positioning shaft, the first driving gear and the second driving gear align symmetrically to engage in the two sides of the swinging gear;

wherein the first transferring device comprises an output gear, the output gear engages in the swinging gear, friction between the damping member and the swinging gear prevents the swinging gear from rotating around its center axis toward a first direction while the swinging plate rotates around the first positioning shaft toward the first direction, thus, the first driving gear and the second driving gear engage with the teeth of the medicine separating member before the output gear rotates.

4. The automatic medicine retrieving device of claim 3, wherein when the medicine separating member rotates to drive the positioning area opposite to the medicine port, the first transferring device drives the swinging plate to drive the second driving gear away from the teeth.

5. The automatic medicine retrieving device of claim 3, wherein a second positioning shaft and a third positioning shaft are attached to the swinging plate, the first driving gear is sleeved on the second positioning shaft, the second driving gear is sleeved on the third positioning shaft, wherein when the first driving gear engages in the teeth of the medicine separating member, the swinging plate rotates around its center axis to drive first driving gear to rotate around the second positioning shaft and drive the second gear to rotate around the third positioning shaft, then the first driving gear drives the medicine separating member to rotate in the first direction.

6. The automatic medicine retrieving device of claim 5, wherein the medicine separating member is annular, and the swinging device further comprises a pushing member;

wherein the pushing member is rotatably sleeved on the second positioning shaft, the pushing member comprises a pushing piece, a blocking piece protrudes from an external side of the medicine separating member;

wherein when the first driving gear engages to the teeth of the medicine separating member, the pushing piece touches the blocking piece.

7. The automatic medicine retrieving device of claim 6, wherein a positioning piece protrudes from an inner side of the medicine separating member, and a stopping piece protrudes from the bearing plate;

wherein when the positioning area is opposite to the medicine port, the positioning piece touches the stopping piece, and the stopping piece prevents the medicine separating member from further rotating in the second direction.

8. The automatic medicine retrieving device of claim 1, wherein the second transferring device comprises a threaded rod and a connecting member, the connecting member is screwed on the threaded rod, the connecting member is attached to the bearing device, the second motor rotates the threaded rod, and wherein when the threaded rod rotates, the connecting member moves up and down along the threaded rod and the bearing device moves up and down with the connecting member.

9. The automatic medicine retrieving device of claim 8, wherein the second transferring device further includes a frame and two guiding poles, the bearing device defines two guiding holes, the bearing device is sleeved on the two guiding poles through the two guiding holes.

10. An automatic medicine retrieving device comprising:

a plurality of medicine trays, each medicine tray comprising:

a bearing plate, the bearing plate defining a medicine port; and a medicine separating member, the medicine separating member rotatably positioned on the bearing plate and defining a plurality of medicine separating areas and a positioning area, wherein a plurality of pills are positioned on the bearing plate and received in the medicine separating areas;

a bearing device;

an accepting mechanism comprising a medicine box opposite to the medicine port; and a driving mechanism, the driving mechanism configured to rotate the medicine separating member from a first position, where the positioning area is opposite to the medicine port to a second position, where the medicine separating area is opposite to the medicine port;

wherein all of the positioning areas of the plurality of the medicine tray are opposite to the medicine port and forms a channel, when the medicine separating area is opposite to the medicine port, the pill in the medicine separating area passes through the channel to fall into the accepting mechanism wherein the driving mechanism drives the medicine separating member to rotate from the second position, where the medicine separating area is opposite to the medicine port, to the first position, where the positioning area is opposite to the medicine port; the driving mechanism comprising a first motor, a first transferring device, a swinging device, and a first driving gear; wherein the first driving gear is positioned on the swinging device, the first transferring device is attached to the first motor and the swinging device, the medicine separating member comprises a plurality of teeth on an external side of the medicine separating member; wherein when the first motor rotates in a forward direction, the first transferring device swings the swinging device in a first swinging direction to drive the first driving gear to engage in the teeth of the medicine separating member; wherein the first driving gear drives the medicine separating member to rotate in a first direction to reach the second position; wherein the first driving gear, the second driving gear, and the swinging device are all positioned on the bearing device, the driving mechanism further comprises a second motor and a second transferring device, the second transferring device is attached to the second motor and the bearing device, the second motor drives the second transferring device to move, and the second transferring device drives the bearing device to move up and down.

11. The automatic medicine retrieving device of claim 10, wherein the driving mechanism further comprises a second transferring device, the second driving gear is positioned on the swinging device, when the first motor rotates in a backward direction, the first transferring device drives the swinging device to swing in a second swinging direction to drive the second driving gear to engage in the teeth of the medicine separating member, wherein, the second swing direction is reverse to the first swinging direction, and wherein the second driving gear drives the medicine separating member to rotate in a second direction, and the medicine separating member moves back to the first position.

12. The automatic medicine retrieving device of claim 11, wherein a first positioning shaft is attached to the bearing device, the swinging device comprises a swinging plate, a damping member, and a swinging gear;

wherein the swinging gear is sleeved on the first positioning shaft, the first driving gear and the second driving gear align symmetrically to engage in the two sides of the swinging gear;

wherein the first transferring device comprises an output gear, the output gear engages in the swinging gear, friction between the damping member and the swinging gear prevents the swinging gear from rotating around its center axis toward a first direction while the swinging plate rotates around the first positioning shaft toward the first direction, thus, the first driving gear and the second driving gear engage with the teeth of the medicine separating member before the output gear rotates.

13. The automatic medicine retrieving device of claim 12, wherein when the medicine separating member rotates to drive the positioning area opposite to the medicine port, the first transferring device drives the swinging plate to drive the second driving gear away from the teeth.

14. The automatic medicine retrieving device of claim 12, wherein a second positioning shaft and a third positioning shaft are attached to the swinging plate, the first driving gear is sleeved on the second positioning shaft, the second driving gear is sleeved on the third positioning shaft, wherein when the first driving gear engages in the teeth of the medicine separating member, the swinging plate rotates around its center axis to drive first driving gear to rotate around the second positioning shaft and drive the second gear to rotate around the third positioning shaft, then the first driving gear drives the medicine separating member to rotate in the first direction.

* * * * *